US006142221A

United States Patent [19]

Johansson

[11] Patent Number: 6,142,221

[45] Date of Patent: Nov. 7, 2000

[54] THREE-CIRCUIT PLATE HEAT EXCHANGER

[75] Inventor: Roger Johansson, Perstorp, Sweden

[73] Assignee: SWEP International AB, Landskrona, Sweden

[21] Appl. No.: 09/029,816

[22] PCT Filed: Aug. 20, 1996

[86] PCT No.: PCT/SE96/01026

§ 371 Date: Jun. 8, 1998

§ 102(e) Date: Jun. 8, 1998

[87] PCT Pub. No.: WO97/08506

PCT Pub. Date: Mar. 6, 1997

[30] Foreign Application Priority Data

Aug. 23, 1995 [SE] Sweden ..... 9502918

[51] Int. Cl.[7] ..... F28D 7/10

[52] U.S. Cl. ..... 165/140; 165/167

[58] Field of Search ..... 165/140, 167, 165/146

[56] References Cited

U.S. PATENT DOCUMENTS 5,462,113 10/1995 Wand ..... 165/167

5,810,071 9/1998 Pavlin ..... 165/284

*Primary Examiner*—Allen Flanigan

*Attorney, Agent, or Firm*—Breiner & Breiner

[57] ABSTRACT

In a three-circuit plate heat exchanger comprising a stack of metal plates (16–25) having identical outer shape and dimensions provided with six holes forming inlet and outlet ports (2–7) for three flows of fluid (x, y and z). The plates are of two different designs, the first (those plates having even reference numerals) having two holes located in plate areas in a common plan and the remaining holes located in a common plan displaced downwards. In the other plate design (the remaining heat exchanging plates) the corresponding four holes are displaced equally upwards relative the remaining two holes. The two types of plates are alternating in the stack. Ring-shaped spacers (27, 28) are sealingly arranged between such plates which are spaced from each other at port holes and forming channels between plates to be blocked from connection with ports forming said holes.

1 Claim, 5 Drawing Sheets

1
2
5
7
8
9
10
13
15
16
17
18
19
20
21
22
23
24
25
26
27
28
29
30
31
D1
D2
D3
x
y
z

THREE-CIRCUIT PLATE HEAT EXCHANGER

The present invention relates to a three-circuit plate heat exchanger.

More particular the invention relates to a three circuit plate heat exchanger comprising a stack of at least 10 sheet metal plates having identical outside shape and dimensions, each of said plates being provided with six spaced holes identically located, holes of the same location having equal diameters in all plates, said plates forming channels for fluids of the three circuits, the holes in the plates forming six ports for inlet and outlet of said fluids of the three circuits.

Heat exchangers of this type are known e.g. from the Patent Abstracts of Japan, Vol 13, No. 582, M-911, Abstract of JP, A, 1-244290 (HISAKA WORKS LTD), Sep. 28, 1989 and from Derwent's abstract, No. 84-4933101, weeek 8401, ABSTRACT OF SU, 1000718 (MOSC MOSZHILNIIPROE), Feb. 28, 1983.

An advantage of using plate heat exchangers is that they have a high heat exchanging capacity relative their volume. Two-circuit plate heat exchangers may be fitted with connections on one or both sides of the exchanger for the two flows of fluid which should exchange heat. It is also a general object to be able to manufacture plate heat exchangers at a low cost—e.g. by gluing, welding or soldering together the plates of the heat exchanger.

The object of the present invention is to design a three-circuit plate heat exchanger which is reliable in operation and cheap in manufacture. It should, therefore, contain a minimum of different heat exchanger plates and said plates should be of a simple design. It should also be. possible to assemble the elements of the exchanger easily and permanently by gluing welding or soldering. The advantage found in two-circuit plate heat exchangers of enabling connection of tubing for the flows of fluid according to wish on either or both sides of the exchanger should be retained.

According to the present invention a three-circuit plate heat exchanger of the type referred to above is characterised in that the plates are of two different designs—the first plate design having two holes located in plate areas in a common plane, while the remaining four holes are located in plate areas displaced equally downwards relative the plane in which said two holes are located—the second plate design having four holes displaced correspondingly upwards relative to its remaining two holes which are located in plate areas in a common plane, that plates of the two different designs are located alternating in the stack of plates, and that at each port the entrance to channels to be passed by fluids of the two circuits not passing said port is blocked by gluing, soldering or welding together of ring shaped plate areas adjacent to said holes, ring shaped spacers being inserted between plates which are spaced from each other at said ring shaped areas adjacent to said holes.

Figure 1:
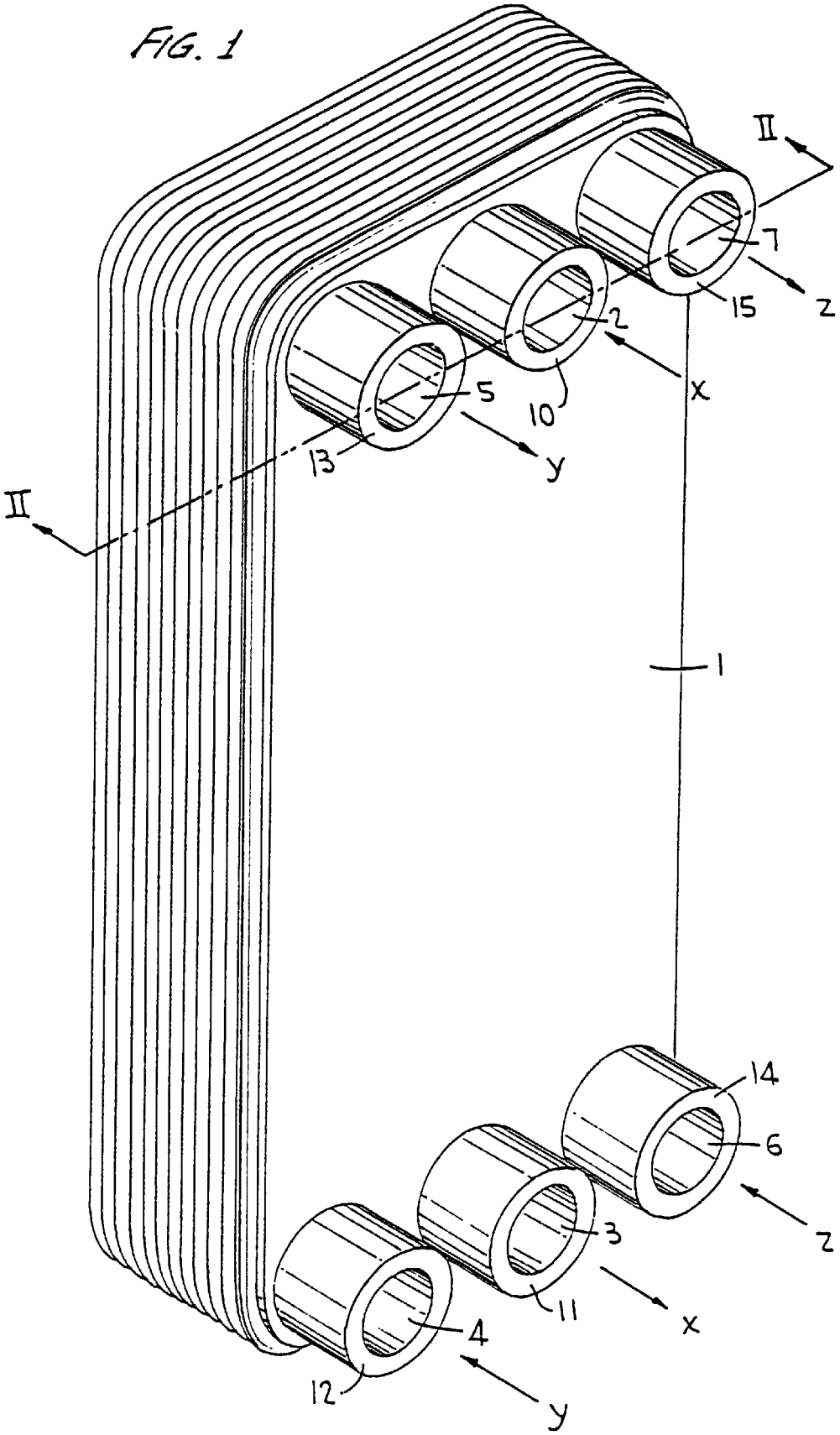
Figure 2:
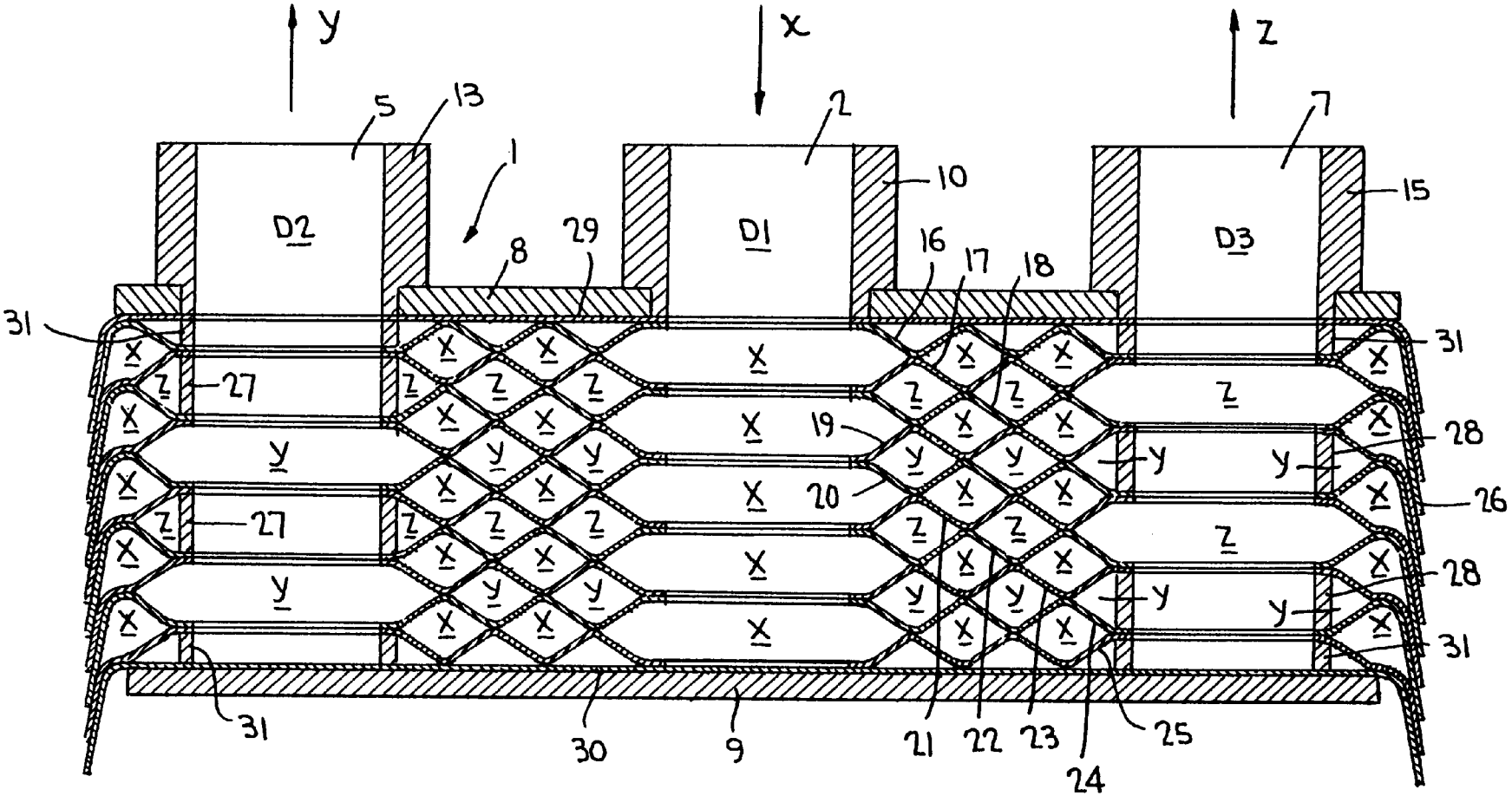

The invention will be described in more detail reference being made to the accompanying drawing in which FIG. 1 is a perspective view of a three-circuit heat exchanger according to the invention, FIG. 2 is a vertical section through the exchanger along the the line II—II in FIG. 1.

Figure 3:
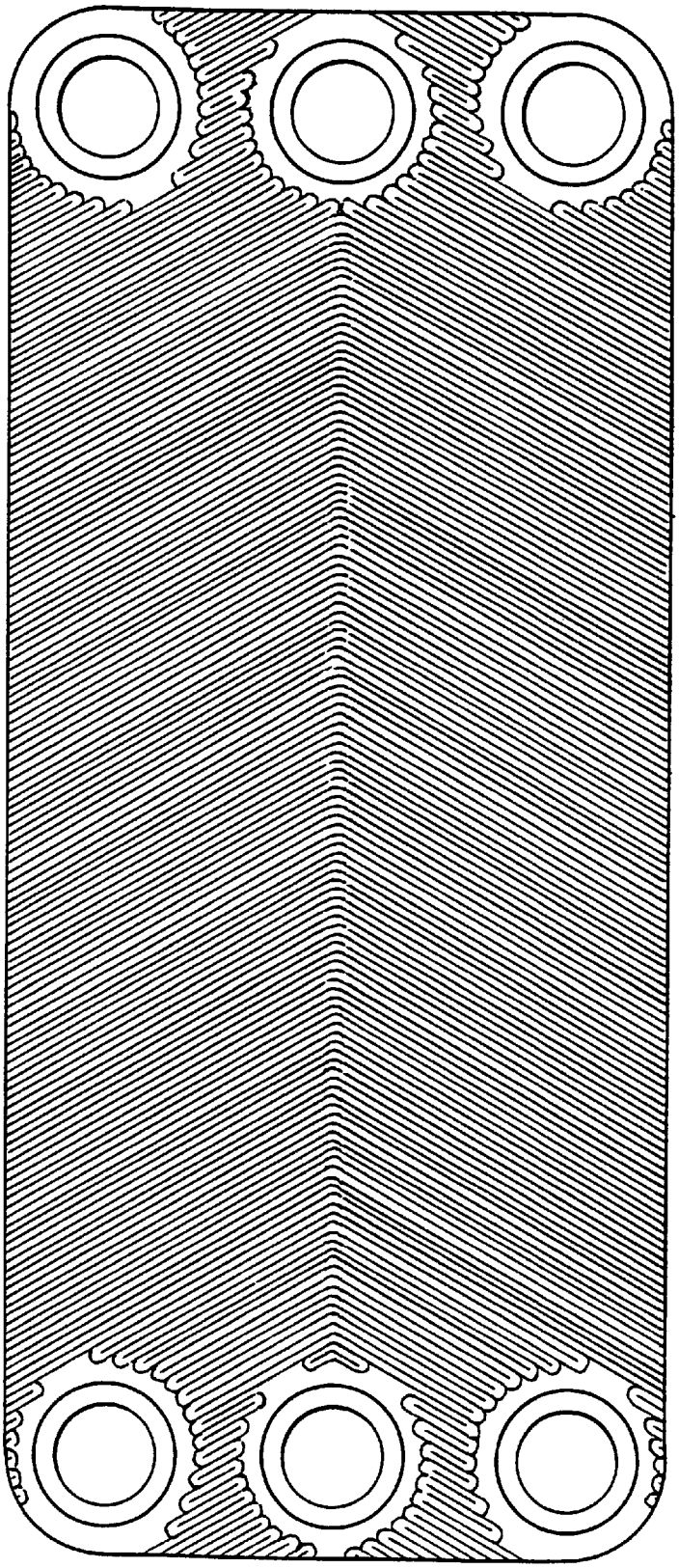
Figure 4:
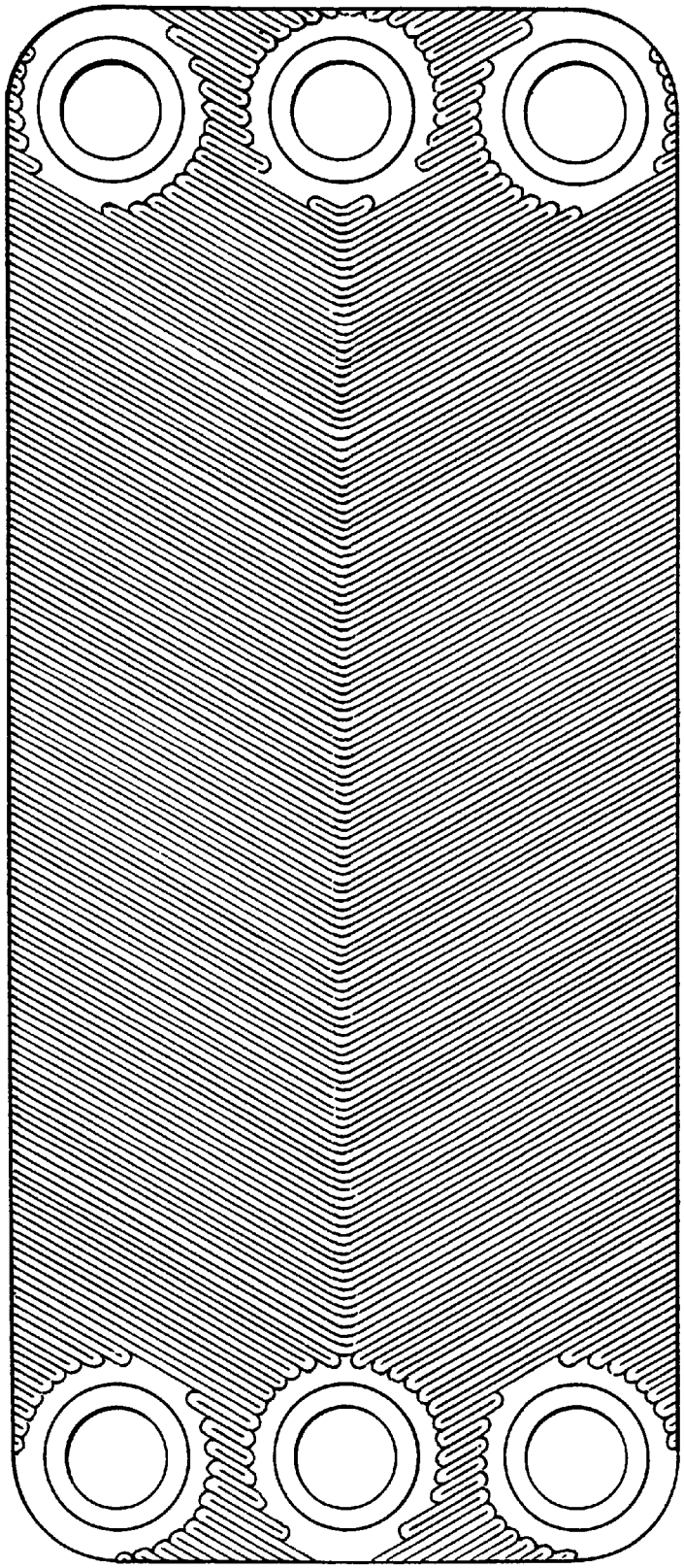
Figure 5:
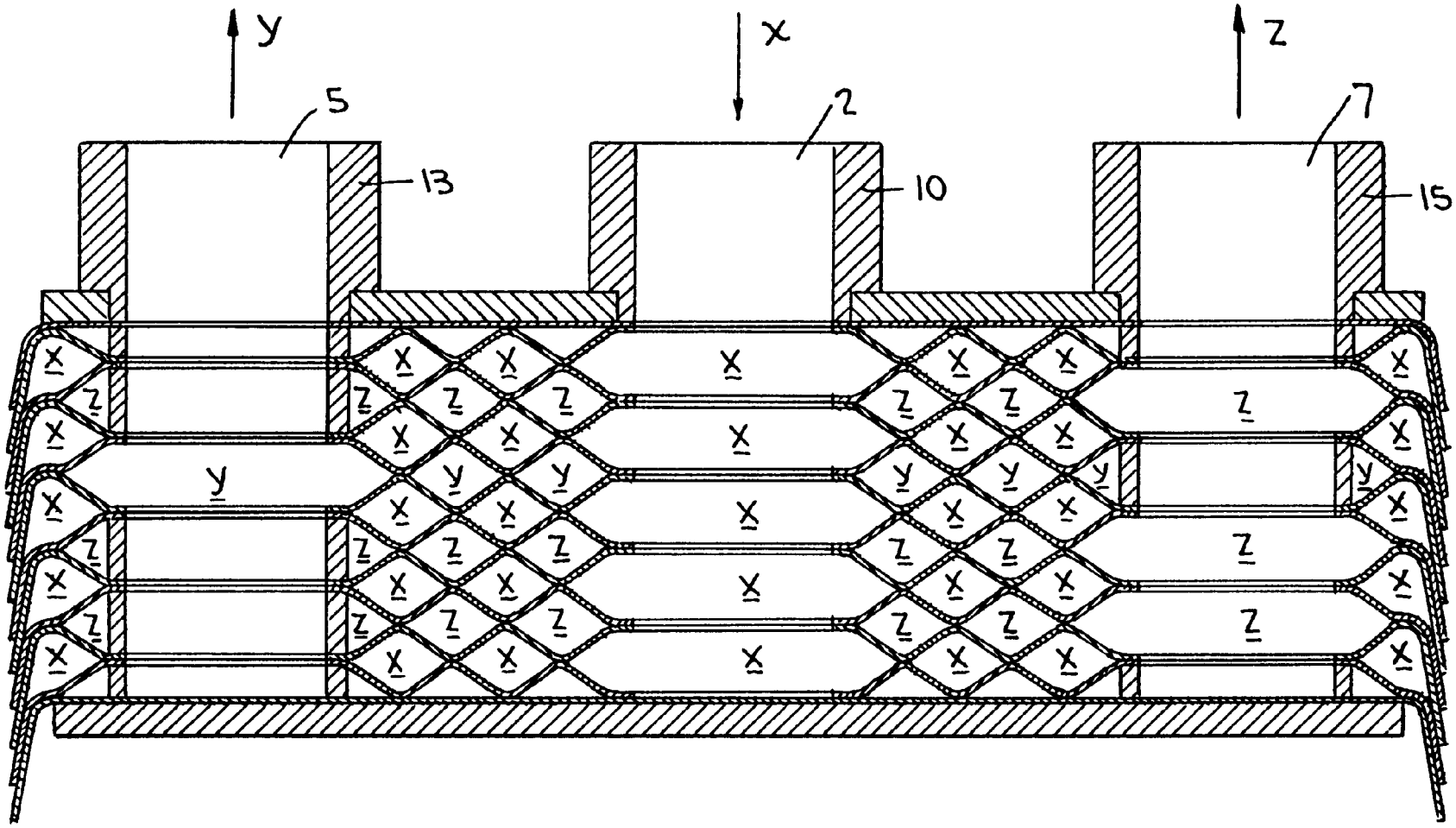

FIG. 3 shows from above one of two types of heat exchanger plates used in the exchanger of FIGS. 1 and 2, FIG. 4 shows from above the other type of heat exchanger plates used, and FIG. 5 shows a section corresponding to that of FIG. 2 through another embodiment of the invention.

Referring first to FIGS. 1 and 2 the plate heat exchanger shown has an outer casing 1 provided with six port inlets and -outlets 2–7 for the three flows of fluid which should pass the exchanger. The first flow of fluid—e.g. cooling water—has been designated by the letter x and enters the exchanger through an inlet port 2 and exits the exchanger via an outlet port 3. One of the two fluids to be cooled has been designated by the letter y and enters through an inlet port 4 and exits via an outlet port 5. The other of the two flows to be cooled has been designated by the letter z and enters via an inlet port 6 and exits via an outlet port 7. FIG. 2 is thus a section through the inlet port 2 for the flow x (the cooling water), the outlet port 5 for the flow y and the outlet port 7 for the flow z.

As shown in FIG. 2 the outer casing 1 has top and bottom end plates 8 and 9 of heavier design for giving physical strength to the exchanger. The top end plate 8 carries fittings 10–15 for tube connections for the three flows x, y and z. The exchanger contains ten heat exchanger plates 16–25 forming channels for the three flows x, y and z. A first group of plates 16, 18, 20, 22 and 24 are identically sized and shaped and the remaining plates 17, 19, 21, 23 and 25 forming a second group are also identically sized and shaped—the shape being different from that of the plates in the first group. Although FIG. 2 is a section through the port inlet 2 and the port outlets 5 and 7 a corresponding section through the port outlet 3 and the port inlets 4 and 6 would have the same appearence. All plates 16–25 are provided with six holes located concentrically with the holes of the six said fittings 10–15, and all plate holes forming an inlet or outlet port are of equal diameter. Although the plate holes shown are of the same diameter at all ports this is not necessary. The ports shown are symmetrically located in the exchanger. Even this is not necessary. The ports could have any location and any of them could open at the bottom end plate 9 in stead of at the top end plate 8.

As best shown in FIG. 2 the holes of each of the heat exchanger plates 16, 18, 20, 22 and 24 forming the inlet port 2 (and the outlet port 3) for the flow of fluid x are formed in ring shaped areas having the outer diameter $D_1$. The said group of plates, being of a first design, have their remaining holes forming port inlets and outlets for the two flows of fluids y and z in ring shaped areas having the diameters $D_2$ and $D_3$ respectively. The ring shaped areas having the diameters $D_2$ and $D_3$ are vertically displaced downwards relative the ring shaped areas having the diameter $D_1$. The remaining heat exchanger plates 17, 19, 21, 23 and 25, being of a second design, have their inlet- and outlet port forming holes located in ring shaped ares of corresponding diameters, but the ring shaped areas at the port inlets and outlets for the flows y and z have been vertically displaced upwards relative the ring shaped areas at the port inlet and outlet for the flow of fluid x. The vertical distance of displacement is the same for all plates.

All heat exchanger plates are provided with a circumferentially, downwards and outwards extending edge 26.

The heat exchanger plates 16–25 are stacked so that each other plate are of the same design. They are sealingly connected by gluing, welding or soldering at their peripheries and at their contacting ring shaped areas having the diameters $D_1$, $D_2$ and $D_3$. The sealing areas have been shown by a thicker line. This connection involves that the flow of fluid x may pass through every other channel limited by the plates 16–25. The said channels are marked by the letter x. At the ports for the flow of fluid y two of the channels have been blocked by inserting and sealingly fastening spacer rings 27 by gluing, welding or soldering. Said channels are marked by the letter z. Finally the remaining channels are blocked similarly at the ports for the flow of fluid z by rings 28. The last mentioned channels are marked by the letter y. For reasons of manufacturing extra plates 29 and 30 having plan surfaces are placed at the top and bottom of the stack of heat exchanger plates 16–25. Ring shaped spacers 31 having half the height of the rings 27 and 28 are located at the ends of the port inlets and outlets 4–8. The said extra plates 29 and 30 and the spacers 31 could be omitted and do not form any part of the invention.

FIG. 5 shows a section corresponding to that of FIG. 2 through a different embodiment.

The three flows of fluid are designated by the letters x, y and z. Again the flow of fluid x is allowed to pass through every other of the channels formed between the heat exchanger plates. However the flow of fluid y is prevented from entrance to three of the remaining channels and the flow of fluid z is prevented from entrance to the only remaining channel.

The two different types of heat exchanger plates used and shown from above in FIGS. 3 and 4 differ from each other not only by the relative vertical dispacements of the ring shaped areas around the port forming holes, but also by being provided with a herring bone design forming ridges and depressions. Said ridges and depressions form arrows of opposite directions in the two types of plates.

It is evident that a three circuit heat exchanger made according to the present invention consists of a minimum of different elements having a very simple design making them easy to manufacture and assemble. All sealing areas around the port holes in the plates are concentrically located at equal diameters at every inlet and outlet port. The ridges and depressions in the channels between the heat exchanger plates are of a type commonly used. They could be omitted or designed otherwise and do not form any part of the invention.

What is claimed is:

1. A three-circuit plate heat exchanger comprising a stack of at least 10 sheet metal plates having identical outside shape and dimensions, each of said plates being provided with six spaced holes identically located, holes of the same location having equal diameters in all plates, said plates forming channels for fluids of the three circuits, the holes in the plates forming six ports for inlet and outlet of said fluids of the three circuits, characterised in that the plates are of two different designs—the first plate design having two holes located in plate areas in a common plane, while the remaining four holes are located in plate areas displaced equally downwards relative the plane in which said two holes are located—the second plate design having four holes displaced correspondingly upwards relative to its remaining two holes which are located in plate areas in a common plane, that plates of the two different designs are located alternating in the stack of plates, that at each port the entrance to channels to be passed by fluids of the two circuits not passing said port is blocked by gluing, soldering or welding together of ring shaped plate areas adjacent to said holes, ring shaped spacers being inserted between plates which are spaced from each other at said ring shaped areas adjacent to said holes, and;

characterised in that the blocking of the channels limited by the plates has been made to allow passage of flow of one fluid through each other channel, and so that one of the two remaining flows of fluid may pass through a number of channels which is greater than the number of channels open to the third flow of fluid.

* * * * *